US006248692B1

(12) United States Patent
Sano et al.

(10) Patent No.: US 6,248,692 B1
(45) Date of Patent: Jun. 19, 2001

(54) ERASABLE IMAGE FORMING MATERIAL

(75) Inventors: Kenji Sano, Tokyo; Satoshi Takayama; Shigeru Machida, both of Kawasaki, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/391,366

(22) Filed: Sep. 8, 1999

(30) Foreign Application Priority Data

Sep. 16, 1998 (JP) ..... 10-261724

(51) Int. Cl.[7] ..... B41M 5/128

(52) U.S. Cl. ..... 503/205; 106/31.16; 106/31.23; 503/213

(58) Field of Search ..... 106/31.16, 31.23; 503/205, 213

(56) References Cited

U.S. PATENT DOCUMENTS 5,922,115 7/1999 Sano et al. ..... 106/31.32

FOREIGN PATENT DOCUMENTS 1-138274 5/1989 (JP) .
58-111873 7/1993 (JP) .

*Primary Examiner*—Bruce H. Hess
(74) *Attorney, Agent, or Firm*—Oblon, Spivak, McClelland, Maier & Neustadt, P.C.

(57) ABSTRACT

An erasable image forming material includes a color former, a developer, and a decolorizer and is erasable by contact with an erase solvent. Free energy $\alpha$ required for the decolorizer and the developer to form a complex and free energy $\beta$ required for the color former and the developer to form a complex have a relationship represented by $\alpha \leqq \beta \leqq 10$ Kcal/mol.

14 Claims, 1 Drawing Sheet

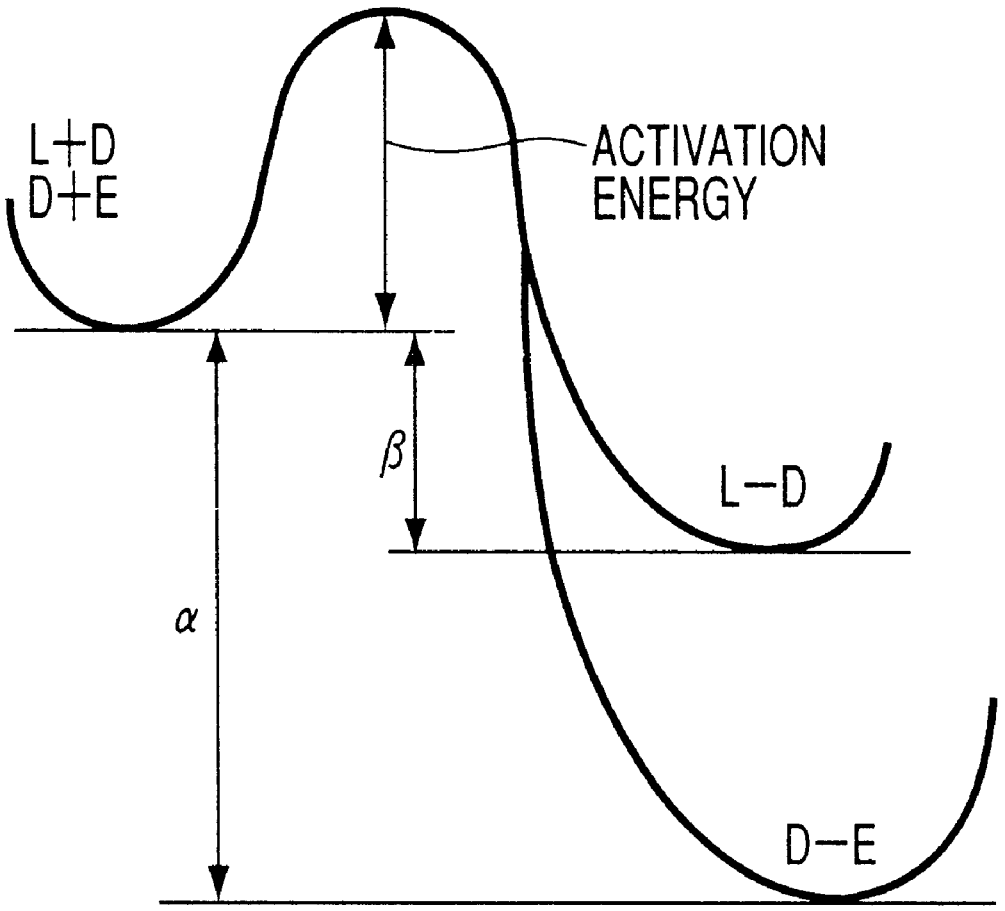
L+D
D+E
ACTIVATION
ENERGY
β
L−D
α
D−E

ERASABLE IMAGE FORMING MATERIAL

BACKGROUND OF THE INVENTION

The present invention relates to an erasable image forming material.

With the recent progress of office automation, the amounts of various pieces of information are significantly increasing, and information output by hard copies is increasing accordingly. Hard copy output is the most basic image display means and superior in versatility and storage stability. However, hard copy output uses large amounts of paper as a recording medium when the information amount increases, and this leads to an increase use of wood resources as the material of paper. Forest resources are very important to maintain the terrestrial environment and suppress the greenhouse effect caused by carbon dioxide. Therefore, it is an important subject to minimize the use of wood resources and efficiently use the paper resources that we presently possess.

Conventionally, paper resources are recycled by processing paper sheets, on which image forming materials are printed, by using large amounts of a bleaching agent and water and remaking paper fibers to manufacture recycled paper with low paper quality. This method raises the cost of recycled paper and causes new environmental pollution resulting from waste liquor disposal.

Hence, the present inventors are developing an image forming material that contains a leuco dye, a developer, and a decolorizer compatible with these components, can form images in the same manner as common image forming materials, and allows formed images to be erased by processing the material with heat or a solvent. Use of this erasable image forming material makes it possible to repeatedly reuse paper sheets any number of times by returning the paper sheets to blank paper sheets by erasing images, with minimum degradation of paper quality. Since recycle need only be done when the paper quality significantly degrades by the reuse, the use efficiency of paper resources greatly improves. In this manner, the essential paper use amount can be reduced, so deforestation can be minimized. Additionally, it is possible to minimize any increase in cost of recycled paper and the environmental pollution by waste liquor disposal that are problems in the present recycle system.

Since this erasable image forming material is a novel material, conditions which can raise the image density in color formation and can well erase images are unclear.

More specifically, common toner or ink uses a completely colored dye, so the image density can be substantially determined by the content of a dye in the toner or ink. In contrast, an erasable image forming material forms color by the interaction between a color former and a developer in the presence of a decolorizer, so factors that determine the image density are very complicated.

Also, when an erasable image forming material is used as toner for electrophotography, if the amounts of a color former and a developer are increased to raise the image density, the amount of a decolorizer also needs to be increased accordingly. When the mixing amounts are thus changed, the ratio of a binder resin reduces compared with common toner. As a consequence, offset (a phenomenon in which toner sticks to a heat roller) readily occurs in the toner fixing process. Analogously, if the ratio of a vehicle (resin or wax) of printing ink reduces, the viscosity or the lipophilic nature degrades. This may pose various problems in the printing process.

On the other hand, the erase characteristics of an erasable image forming material have not been taken into consideration in the past. Accordingly, conditions by which a good erased state can be obtained are naturally unknown.

BRIEF SUMMARY OF THE INVENTION

It is an object of the present invention to provide an erasable image forming material that clarifies conditions by which high image density and a good erased state can be obtained, and also improves other characteristics, such as offset resistance, by relaxing requirements for other components.

An erasable image forming material of the present invention comprises a color former, a developer, and a decolorizer, wherein free energy $\alpha$ required for the decolorizer and the developer to form a complex and free energy $\beta$ required for the color former and the developer to form a complex have a relationship represented by $\alpha \leqq \beta \leqq 10$ kcal/mol.

Another erasable image forming material of the present invention comprises a color former, a developer, and a decolorizer and is erasable by contact with an erase solvent, wherein free energy $\alpha$ required for the decolorizer and the developer to form a complex and free energy $\beta$ required for the color former and the developer to form a complex have a relationship represented by $\alpha \leqq \beta \leqq 10$ kcal/mol.

The erasable image forming material of the present invention preferably further comprises a material having a function of suppressing outflow of the color former, the developer, and the decolorizer from an image region formed by the image forming material when the erase solvent enters the image region.

Still another erasable image forming material of the present invention comprises a color former, a developer, and a decolorizer and is erasable by contact with an erase solvent, wherein the decolorizer and the developer have the following relationship:

$$0 \leqq \Delta Rf \leqq 0.1$$

where $\Delta Rf$ is the difference between Rf values, represented by (component moving distance/solvent moving distance), of the decolorizer and the developer when the decolorizer and the developer are separated by chromatography using the erase solvent.

Still another erasable image forming material of the present invention comprises a color former L, a developer D, and a decolorizer, wherein the color former L and the developer D satisfy concentration [D]≧ concentration [L] in a solvent and are mixed under a condition by which the optical density of a solution is proportional to a concentration product [D]·[L], and the mixture is further mixed with the decolorizer.

In this erasable image forming material, the absorbance of a solution with a concentration of 5 mmol/L, prepared by dissolving the color former L and the developer D in a solvent with a dielectric constant of 4 to 80, is preferably 1.0 or more.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawing, which is incorporated in and constitute a part of the specification, illustrates presently preferred embodiments of the invention, and together with the general description given above and the detailed description of the preferred embodiments given below, serve to explain the principles of the invention.

The single FIGURE is a graph for explaining free energy $\alpha$ required for a decolorizer and a developer to form a complex and free energy $\beta$ required for a color former and the developer to form a complex.

DETAILED DESCRIPTION OF THE INVENTION

The present invention will be described in more detail below.

The image forming material of the present invention can develop and lose color by the use of a color former, a developer, and a decolorizer. This image forming material can be erased by heat or contact with a solvent. In the present invention, the color former is a precursor compound of a dye which forms colored information such as characters and graphics. The developer is a compound which develops the color former by the interaction (principally exchange of electrons) between the developer and the color former. The color former and the developer develop color when the interaction between them increases and lose color when the interaction reduces. The decolorizer is a substance having a function of preferentially dissolving with the developer to reduce the color former-developer interaction and thereby lose color, when the image forming material melts or softens by heating or when an erase solvent permeates the image forming material.

In the present invention, the term "erasure" means that (a) the reflection density of the image region after the erasure treatment is lowered to ⅓ or less of the reflection density of the image formed, or (b) the difference between the reflection density in the image region after the erasure treatment and the reflection density of the background is lowered to 0.1 or less. It is desirable to meet both of these conditions (a) and (b).

First, the condition that free energy $\alpha$ required for the decolorizer and the developer to form a complex and free energy $\beta$ required for the color former and the developer to form a complex have a relationship $\alpha \leqq \beta \leqq 10$ kcal/mol will be described below. This relationship is a measure of the degree of affinity of the developer to the decolorizer or the color former. The above expression means that the formation of a complex by the decolorizer and the developer is easier than the formation of a complex by the color former and the developer, but the difference between them is preferably not so large. If this difference is too large, color formation becomes difficult. Each free energy is preferably 10 kcal/mol or less and, more preferably, 5 kcal/mol or less. If this condition is met, high image density and a good erased state can be obtained by appropriately setting the mixing ratios of the three components.

This relationship can be verified by forming a mixture of the three components, by solvent evaporation from a solution or cooling from a molten state, and checking for the composition. Also, the free energy for complex generation can be quantitatively estimated by differential scanning calorimetry (DSC) or the like. This complex generating free energy can also be replaced with exothermic heat. More specifically, the free energy is evaluated in terms of a value obtained by dividing the area of exothermic peak in DSC by its weight. In the present invention, the exotherm caused by the generation of a complex by the decolorizer and the developer must be larger than that caused by the color former and the developer. In this case, the composition system is signed thermodynamically, rather than thermochemically. That is, when the exotherm increases its value with minus sign, the amount of released energy increases and the stability rises accordingly.

FIGURE shows the free energies $\alpha$ and $\beta$. Referring to FIGURE, both $\alpha$ and $\beta$ have minus values.

The erasable image forming material preferably contains a material having a function of suppressing outflow of the color former, developer, and decolorizer from the image forming material when an erase solvent enters. Examples of this material are a toner binder and a microcapsule shell material. When an erase solvent contacts the image forming material fixed as an image on a paper sheet, the solvent swells a binder or the like to penetrate into it and dissolves any soluble material. If this binder or the like has a function of confining other components, these components are held in position without flowing out from the image forming material. Consequently, the developer is absorbed by, or combines with, the decolorizer in an image region to well lose color.

Next, the condition by which a good erased state can be obtained by inkjet ink or normal ink not containing any binder will be described below. In an image forming material like this, whether a good erased state can be obtained can be checked by using, as parameters, Rf values represented by (component moving distance/solvent moving distance) when the decolorizer and the developer are separated by chromatography using an erase solvent. That is, a difference $\Delta Rf$ between the Rf values of the decolorizer and the developer preferably satisfies a relation $0 \leqq \Delta Rf \leqq 0.1$. As in the above case, the free energy $\alpha$ required for the decolorizer and the developer to form a complex and the free energy $\beta$ required for the color former and the developer to form a complex must have the relationship $\alpha \leqq \beta \leqq 10$ kcal/mol.

This condition can be evaluated as follows. An image is formed on a paper sheet, and the image forming material is allowed to move or travel, together with an erase solvent, in the same manner as paper chromatography. The Rf values, represented by (component moving distance/solvent moving distance), of the decolorizer and the developer are checked, and the difference $\Delta Rf$ between them is calculated. This shows the movability or diffusibility, resulting from the action of the solvent, of each component. The condition $0 \leqq \Delta Rf \leqq 0.1$ means that there is no large difference between the movability or diffusibility, resulting from the action of the solvent, of the decolorizer and that of the developer. If the difference $\Delta Rf$ between them is large, erasure is incomplete. For example, if the decolorizer remains although the developer and the color former move together with the solvent, recoloration readily occurs after the solvent is removed by drying.

Conditions by which the image forming material of the present invention shows high image density will be described below. In the present invention, it is preferable that a color former L and a developer D meet concentration $[D] \geqq$ concentration $[L]$ in a solvent and be mixed under conditions by which the optical density of the solution is proportional to a concentration product $[D] \cdot [L]$ (i.e., conditions by which equilibrium is established), and the mixture be further mixed with a decolorizer.

In this case, the absorbance of a solvent with a concentration of 5 mmol/L, prepared by dissolving the color former L and the developer D in a solvent with a dielectric constant of 4 to 80, is preferably 1.0 or more.

The present inventors measured absorption spectra by dissolving the color former and the developer in a solvent at different concentrations and found that the absorbance abruptly rose when these concentrations increased. This is probably because equilibrium is established as follows between the system in which the color former and the developer are separated and the system in which the color former and the developer form a complex. In this case, an equilibrium constant K is represented by $$L+D \rightleftarrows L-D$$

$$K=[L-D]/[L][D]$$

According to the Lambert-Beer law, the absorbance A is represented by the following equation:

$$A=abc$$

where a is a constant, b is a cell constant (=1 cm), and C is a concentration. Thus, in the present invention, the absorbance A is represented by the following equation:

$$A = a \times 1 \times K[L][D]$$

$$= aK[L][D]$$

The constant aK includes the equilibrium constant K. Therefore, the absorption A is affected by the equilibrium constant K.

Assuming that a concentration ratio [D]:[L] is 1:1, a concentration [L–D] is proportional to $K[L]^2$. This agrees well with the result that the absorbance abruptly rose with increasing concentrations of the color former and the developer. This also agrees well with the result that the absorbance abruptly lowers when a well colored solution is diluted.

Accordingly, the image forming material exhibits high image density when the color former L and the developer D meet concentration [D]≧concentration [L] in a solvent and are mixed under conditions by which equilibrium is attained to result in a good colored state. Also, the fact that the absorbance abruptly lowers when a well colored solution is diluted means that when a solvent enters the image forming material, the equilibrium moves in the direction of erasure and the image density lowers accordingly.

In the present invention, the characteristics of a paper sheet as an image recording medium also have influence on the erase performance. For example, in a case of an acidic paper sheet in which a sulfuric acid band is used, this acidic component may cause recoloration. Similarly, phenolic resin often used as a vehicle component of news paper printing ink may remain in recycled paper, and this phenolic resin can also cause recoloration because the resin is acidic. By contrast, the erase performance can be stabilized by the use of an alkaline component such as calcium carbonate. An acidic textile size or size agent also has an adverse effect on the erase performance. To prevent this, it is desirable to use starch or a polar polymer having erase properties as a textile size.

The individual components used in the present invention will be described in more detail below.

Examples of the color former used in the present invention are electron-donating organic substances such as leucoauramine, diarylphthalide, polyarylcarbinole, acylauramine, arylauramine, Rhodamine B lactam, indoline, spiropyran, and fluoran. Practical examples are Crystal Violet lactone (CVL), Malakite Green lactone, 2-anilino-6-(N-cyclohexyl-N-methylamino)-3-methylfluoran, 2-anilino-3-methyl-6-(N-methyl-N-propyl-amino)fluoran, 3-[4-(4-phenylaminophenyl)aminophenyl]-amino-6-methyl-7-chlorofluoran, 2-anilino-6-(N-methyl-N-isobutylamino)-3-methylfluoran, 2-anilino-6-(dibutyl-amino)-3-methylfluoran, 3-chloro-6-(cyclohexylamino)-fluoran, 2-chloro-6-(diethylamino)fluoran, 7-(N,N-dibenzylamino)-3-(N,N-diethylamino)fluoran, 3,6-bis(diethylamino)fluoran, γ-(4'-nitroanilino)lactam, 3-diethylaminobenzo[a]-fluoran, 3-dietylamino-6-methyl-7-aminofluoran, 3-diethylamino-7-xylidinofluoran, 3-(4-diethylamino-2-ethoxyphenyl)-3-(1-ethyl-2-methylindole-3-yl)-4-azaphthalide, 3-(4-diethylaminophenyl)-3-(1-ethyl-2-methylindole-3-yl) phthalide, 3-diethylamino-7-chloroanilinofluoran, 3-diethylamino-7,8-benzofluoran, 3,3-bis(1-n-butyl-2-methylindole-3-yl)phthalide, 3,6-dimethylethoxyfluoran, 3-diethylamino-6-methoxy-7-aminofluoran, DEPM, ATP, ETAC, 2-(2-chloroanilino)-6-dibutylaminofluoran, Crystal Violet carbinol, Malachite Green carbinol, N-(2,3-dichlorophenyl)leucoauramine, N-benzoylauramine, Rhodamine B lactam, N-acetylauramine, N-phenylauramine, 2-(phenyliminoethanedilydene)-3,3-dimethylindoline, N,3,3-trimethylindolinobenzospiropyran, 8'-methoxy-N,3,3-trimethylindolinobenzospiropyran, 3-diethylamino-6-methyl-7-chlorofluoran, 3-diethylamino-7-methoxyfluoran, 3-diethyamino-6-benzyloxyfluoran, 1,2-benzo-6-diethyaminofluoran, 3,6-di-p-toluidino-4,5-dimetylfluoran, phenylhydrazide-γ-lactam, and 3-amino-5-methylfluoran. These color former compounds can be used singly or in the form of a mixture of two or more species. If color formers are selected properly, a variety of colored states can be obtained, and thus formation of multicolor image can be attained.

Examples of the developer are acidic compounds such as phenols, metal phenolates, metal carboxylates, benzophenones, sulfonic acids, sulfonates, phosphoric acids, metal phosphates, acidic phosphoric esters, acidic phosphoric ester metal salts, phosphorous acids, and metal phosphites. Practical examples are gallic acid; gallate such as methyl gallates, ethyl gallate, n-propyl gallate, i-propyl gallate, and butyl gallate; dihydroxybenzoic acids and their esters such as 2,3-dihydroxybenzoic acid and 3,5-dihydroxybenzoic acid methyl; acetophenone derivatives such as 2,4-dihydroxyacetophenone, 2,5-dihydroxyacetophenone, 2,6-dihydroxyacetophenone, 3,5-dihydroxyacetophenone, and 2,3,4-trihydroxyacetophenone; benzophenone derivatives such as 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, and 2,3,4,4'-tetrahydroxybenzophenone; biphenols such as 2,4'-biphenol and 4,4'-biphenol; and polyhydric phenols such as 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis (benzene-1, 2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, and methylenetris-p-cresol. These compounds can be used singly or in the form of a mixture of two or more species.

The decolorizer used in the present invention can be a low-molecular organic material such as a sterol compound or cyclic sugar alcohol or its derivative, and can also be a polymer decolorizer. This decolorizer can be contained in either the image forming material or an erase solvent.

Examples of the decolorizer are sterol compounds such as animal sterins, plant sterins, and fungi sterins. Examples of the animal sterins are cholesterol, lanosterol, lanostadial, agnosterol, cholestanol, coprostanol, ostreasterol, actiniasterol, spongosterol, and clionasterol. Examples of bile acid are cholanoic acid, cholic acid, hyodeoxycholic acid, and lithocholic acid. Examples of the plant sterins are stegmasterol, α-sitosterol, β-sitosterol, γ-sitosterol, brassicasterol, and vitamin D. An example of the fungi sterins is ergosterol. One or more types of these compounds can be used. A material, e.g., lanolin alcohol, which is originally a mixture is also usable.

Other examples of the decolorizer are cholic acid, lithocholic acid, testosterone, cortisone, and their derivatives, each having very high compatibility with the developer. Practical examples are cholic acid, methylester cholate, sodium cholate, lithocholic acid, methylester lithocholate, sodium lithocholate, hyodeoxycholic acid, methylester hyodeoxycholate, testosterone, methyltestosterone, 11 α-hydroxymethyltestosterone, hydrocortisone, cholesterolmethylcarbonate, and α-cholestanol. Of these compounds, a compound having two or more hydroxyl groups is preferable.

Other examples of the decolorizer are cyclic sugar alcohol and its derivatives, as a compound (phase separation inhibitor) which is highly amorphous and has a function of inhibiting phase separation of a composition system. Practical examples are D-glucose, D-mannose, D-galactose, D-fructose, L-sorbose, L-rhamnose, L-fucose, D-ribodesose, α-D-glucose=pentaacetate, acetoglucose, diacetone-D-glucose, D-glucuronic acid, D-galacturonic acid, D-glucosamie, D-fructosamine, D-isosaccharic acid, vitamin C, erutorubic acid, trehalose, saccharose, maltose, cellobiose, gentiobiose, lactose, melibiose, raffinose, gentianose, melizitose, stachyose, methyl=α-glucopyranoside, salicin, amygdalin, euxanthic acid, coarse white sugar, fine granulated sugar, and extra fine white sugar. One or more types of these compounds can be used.

Other examples of the decolorizer are a non-aromatic cyclic compound, other than cyclic sugar alcohols, of a 5-membered or larger ring having a hydroxyl group, and derivatives of cyclic sugar alcohols, as slightly amorphous phase separation inhibitors. Practical examples are alicyclic monohydric alcohols such as cyclododecanol, hexahydrosalicylic acid, menthol, isomenthol, neomenthol, neoisomenthol, carbomenthol, α-carbomenthol, piperithol, α-terpineol, β-terpineol, γ-terpineol, 1-p-menthene-4-ol, isopulegol, dihydrocarveol, and carveol; alicyclic polyhydric alcohols such as 1,4-cyclohexanediol, 1,2-cyclohexanediol, phloroglucitol, quercitol, inositol, 1,2-cyclododecane diol, quinic acid, 1,4-terpene, 1,8-terpene, pinol hydrate, and betulin; polycyclic alcohol derivatives such as borneol, isoborneol, adamantanol, norborneol, fenchol, camphor, and isosorbite; and derivatives of cyclic sugar alcohols such as 1,2:5,6-diisopropylidene-D-mannitol. One or more types of these compounds can be used. It is preferable to combine a highly amorphous phase separation inhibitor and a slightly amorphous phase separation inhibitor.

Examples of the polymer decolorizer are starch (e.g., potato starch and corn starch) made from grains, dogtooth violet starch, wheat flour, and rice flour. Materials containing soybean protein components can also be used.

In addition, a synthetic polymer decolorizer (polymer or oligomer) is also usable. Practical examples are cellulose, cellulose derivatives (e.g., nitrocellulose, ethylcellulose, and acetylcellulose), polyacrylic acid, polymethacrylic acid, polyviphenylacrylate, polyacrylamide, polymethacrylamide, polyvinylester (e.g., polyvinylacetate), polyphenylene, polyethersulfone, polyetherketone, polysulfone, polyvinylpyrrolidone, polyamide, polybenzimidazole, polyphenyleneether, polyphenylenesulfide, polycarbonate, polydivinylbenzene, and melamine resin. It is also possible to use a styrene-acrylate copolymer, styrene-acrylic acid copolymer, styrene-methacrylic acid copolymer, and styrene-epoxy modified styrene copolymer, in each of which the weight ratio of a polar monomer is 20 wt % or more.

In the present invention, the material having the function of suppressing outflow of the color former, developer, and decolorizer from the image forming material, caused by penetration of an erase solvent, is basically a material sparingly soluble in the erase solvent. In general, this material is preferably a polymer. Examples are a binder and a microcapsule shell material having a large effect of confining other components.

When the image forming material of the present invention is to be erased by bringing it into contact with a solvent (including the decolorizer), this solvent preferably (A) promotes the formation of hydrogen bonds between the developer and the decolorizer, and (B) has high affinity to a matrix agent (binder resin or wax) and readily penetrates into the interior of the image forming material. Solvents meeting property (A) can be used singly. The two properties can also be met by mixing two or more types of solvents.

The erase solvent preferably uniformly dissolves the color former and the developer at a concentration of 0.1 mmol/L or more. This is so because a solvent having high solubility facilitates diffusion of the color former and the developer and encourages the developer and the decolorizer to dissolve each other, thereby achieving a good erased state.

Examples of the solvents (the first group) satisfying both properties (A) and (B) are ethers, ketones, and esters. Practical examples are saturated ethers such as ethyl ether, ethyl propyl ether, ethyl isopropyl ether, isopentyl methyl ether, butyl ethyl ether, dipropyl ether, diisopropyl ether, ethyl isopentyl ether, dibutyl ether, dipentyl ether, diisopentyl ether, and dihexyl ether; unsaturated ethers such as ethyl vinyl ether, allyl ethyl ether, diallyl ether, and ethyl propargyl ether; ethers of dihydric alcohols such as 2-methoxyethanol, 2-ethoxyethanol, 2-butoxyethanol, 1,2-dimethoxyethane, 1,2-diethoxyethane, and 1,2-dibutoxyethane; cyclic ethers such as oxetane, tetrahydrofuran, tetrahydropyran, dioxolane, dioxane, and trioxane; saturated ketones such as acetone, methyl ethyl ketone, methyl propyl ketone, diethyl ketone, isopropyl methyl ketone, butyl methyl ketone, ethyl propyl ketone, isobutyl methyl ketone, pinacolone, methyl pentyl ketone, butyl ethyl ketone, dipropyl ketone, diisopropyl ketone, hexyl methyl ketone, isohexyl methyl ketone, heptyl methyl ketone, and dibutyl ketone; unsaturated ketones such as ethylidene acetone, allyl acetone, and mesityl oxide; cyclic ketones such as cyclopentanone, cyclohexanone, cycloheptanone, and cyclooctanone; and esters such as ethyl formate, propyl formate, butyl formate, isobutyl formate, pentyl formate, isopentyl formate, ethyl acetate, isopropyl acetate, propyl acetate, butyl acetate, isobutyl acetate, pentyl acetate, isopentyl acetate, sec-amyl acetate, hexyl acetate, allyl acetate, 2-methoxyethyl acetate, 2-ethoxyethyl acetate, 1,2-diacetoxy ethane, methyl propionate, ethyl propionate, propyl propionate, isopropyl propionate, butyl propionate, pentyl propionate, isopentyl propionate, sec-amyl propionate, 2-methoxypropyl acetate, 2-ethoxypropyl acetate, methyl butyrate, ethyl butyrate, propyl butyrate, isopropyl butyrate, butyl butyrate, pentyl butyrate, isopentyl butyrate, sec-amyl butyrate, methyl isobutyrate, ethyl isobutyrate, propyl isobutyrate, isopropyl isobutyrate, butyl isobutyrate, pentyl isobutyrate, isopentyl isobutyrate, sec-amyl isobutyrate, methyl valerate, ethyl valerate, propyl valerate, isopropyl valerate, butyl valerate, methyl hexanoate, ethyl hexanoate, propyl hexanoate, and isopropyl hexanoate. Examples of additional solvents are methylene chloride, γ-butyrolactone, β-propiolactone, n-methylpyrrolidinone, dimethyl formamide, dimethyl acetamide, and dimethyl sulfoxide. These solvents can be used singly or in the form of a mixture of two or more species. In the case of using mixed solvents, the mixing ratio can be determined arbitrarily.

Examples of the solvents (the second group) satisfying property (A) and singly usable, though the affinity with a general binder resin is low, are water, methyl alcohol, ethyl alcohol, propyl alcohol, isopropyl alcohol, butyl alcohol, isobutyl alcohol, pentyl alcohol, 2-pentyl alcohol, 3-pentyl alcohol, isopentyl alcohol, 1-hexanol, 2-hexanol, 3-hexanol, cyclopentanol, cyclohexanol, ethylene glycol, propylene glycol, butylene glycol, and glycerin.

On the other hand, examples of the solvents (the third group) having a high affinity with the binder resin but failing to satisfy property (A) are toluene, ethylbenzene, propylbenzene, cumene, butylbenzene, isobutylbenzene, sec-butylbenzene, pentylbenzene, diethylbenzene, mesitylene, xylene, cresol, ethylphenol, dimethoxybenzene, dimethoxytoluene, benzyl alcohol, tolyl carbinol, cumyl alcohol, acetophenone, propiophenone, hexane, pentane, heptane, octane, cyclohexane, cyclopentane, cycloheptane, cyclooctane, and petroleum fractions (e.g., petroleum ether and benzene).

The first group of solvents given above can be used singly satisfactorily. The second group of solvents, which can certainly be used singly, should desirably be mixed with the first group of solvents. Since each of these first and second groups of solvents exhibits a decoloring capability, these solvents can be mixed at an arbitrary mixing ratio. Where a solvent of the second group is mixed with a solvent of the third group, the mixing ratio is not particularly limited as far as the mixed solvents exhibit a sufficient decoloring capability. However, it is desirable for the mixing amount of the third group solvent to fall within the range of between 20 and 80 wt %. It is also possible to use a third group solvent together with a first group solvent. In this case, the mixing amount of the third group solvent should be 90 wt % or less. Further, it is possible to use the first, second, and third group solvents together. In this case, it is desirable for the mixing amount of the third group solvent to be 80 wt % or less.

When a natural material such as ethylbutylate (pineapple oil) having very small influence on the environment is used as the solvent, no problem arises during disposal of the image forming material even if the solvent remains.

EXAMPLES

The present invention will be described by way of its examples.

Example 1

1 mol of Crystal Violet lactone (CVL) as a color former and 1.2 mol of propyl gallate as a developer were dissolved in methylene chloride (dielectric constant 8.9) to prepare a homogeneous solution. The solvent was evaporated, and the resultant material was dried to develop color. When CVL and propyl gallate are dissolved in methylene chloride at the above mixing ratio, the absorbance increases in proportion to the product of the concentrations. Therefore, the absorbance abruptly increases in the process of evaporating the solvent. On the other hand, when the concentrations are decreased the absorbance abruptly lowers.

4 parts by weight of the colored mixture of CVL and propyl gallate formed as above, 10 parts by weight of cholic acid as a decolorizer, 1 part by weight of 1-docosanol as wax, 83 parts by weight of a styrene-butyl acrylate copolymer (acrylate content 6 wt %) as a binder resin, and 1 part by weight of a charge control agent (LR-147 manufactured by Nippon Carret Inc.) were mixed, and the mixture was well kneaded using a kneader. The kneaded product was pulverized by a pulverizer to obtain a powder having an average particle size of 10 μm. 1 part by weight of hydrophobic silica was externally added to the resultant powder to manufacture blue electro-photographic toner.

The manufactured toner was put into a toner cartridge of a copying machine (Premarge 38 manufactured by TOSHIBA CORP.), and an image was transferred onto a paper sheet. The reflection density of the formed image was about 1.0. This paper sheet was dipped in diethoxyethane to erase the image and dried. The reflection density of the paper sheet after the image was erased was about 0.14.

As a control, 2 parts by weight of Crystal Violet lactone (CVL) as a color former, 2 parts by weight of propyl gallate as a developer, 10 parts by weight of cholic acid as a decolorizer, 1 part by weight of 1-docosanol as wax, 94 parts by weight of a styrene-butyl acrylate copolymer (acrylate content 6 wt %) as a binder resin, and 1 part by weight of a charge control agent (LR-147 manufactured by Nippon Carret Inc.) were mixed, and the mixture was well kneaded using a kneader. The kneaded product was pulverized by a pulverizer to obtain a powder having an average particle size of 10 μm. 1 part by weight of hydrophobic silica was externally added to the resultant powder to manufacture blue electrophotographic toner.

The manufactured toner was put into a toner cartridge of a copying machine (Premarge 38 manufactured by TOSHIBA CORP.), and an image was transferred onto a paper sheet. The reflection density of the formed image was about 0.6. This paper sheet was dipped in diethoxyethane to erase the image and dried. The reflection density of the paper sheet after the image was erased was about 0.14. As described above, when the color former and the developer were mixed with other components without dissolving in a solvent and evaporating the solvent to develop color, no satisfactory coloration could be obtained.

Example 2

Following the same procedures as in Example 1, 1 mol of Crystal Violet lactone (CVL) as a color former and 1.2 mol of propyl gallate as a developer were dissolved in methylene chloride to prepare a homogeneous solution. The solvent was evaporated, and the resultant material was dried to develop color.

2 parts by weight of the colored mixture thus formed, 10 parts by weight of cholic acid as a decolorizer, 1 part by weight of 1-docosanol as wax, 86 parts by weight of a styrene-butyl acrylate copolymer (acrylate content 6 wt %) as a binder resin, and 1 part by weight of a charge control agent (LR-147 manufactured by Nippon Carret Inc.) were mixed, and the mixture was well kneaded using a kneader. The kneaded product was pulverized by a pulverizer to obtain a powder having an average particle size of 10 μm. 1 part by weight of hydrophobic silica was externally added to the resultant powder to manufacture blue electrophotographic toner.

The manufactured toner was put into a toner cartridge of a copying machine (Premarge 38 manufactured by TOSHIBA CORP.), and an image was transferred onto a paper sheet. The reflection density of the formed image was about 1.2. This paper sheet was dipped in diethoxyethane to erase the image and dried. The reflection density of the paper sheet after the image was erased was about 0.14.

Example 3

1 mol of PSD-184 (Nippon Soda Co. Ltd.) as a color former and 1 mol of propyl gallate as a developer were dissolved in ethyl alcohol to prepare a homogeneous solution. The solvent was evaporated, and the resultant material was dried to develop color. 4 parts by weight of this colored mixture, 10 parts by weight of cholic acid as a decolorizer, 1 part by weight of 1-docosanol as wax, 84 parts by weight of a styrene-butyl acrylate copolymer (acrylate content 6 wt %) as a binder resin, and 1 part by weight of a charge control agent (LR-147 manufactured by Nippon Carret Inc.) were mixed, and the mixture was well kneaded using a kneader. The kneaded product was pulverized by a pulverizer to obtain a powder having an average particle size of 10 $\mu$m. 1 part by weight of hydrophobic silica was externally added to the resultant powder to manufacture black electrophotographic toner.

The manufactured toner was put into a toner cartridge of a copying machine (Premarge 38 manufactured by TOSHIBA CORP.), and an image was transferred onto a paper sheet. The reflection density of the formed image was about 1.5. This paper sheet was dipped in diethoxyethane to erase the image and dried. The reflection density of the paper sheet after the image was erased was about 0.1.

As a control, 2 parts by weight of PSD-184 (Nippon Soda Co. Ltd.) as a color former, 2 parts by weight of propyl gallate as a developer, 10 parts by weight of cholic acid as a decolorizer, 1 part by weight of 1-docosanol as wax, 84 parts by weight of a styrene-butyl acrylate copolymer (acrylate content 6 wt %) as a binder resin, and 1 part by weight of a charge control agent (LR-147 manufactured by Nippon Carret Inc.) were mixed, and the mixture was well kneaded using a kneader. The kneaded product was pulverized by a pulverizer to obtain a powder having an average particle size of 10 $\mu$m. 1 part by weight of hydrophobic silica was externally added to the resultant powder to manufacture black electrophotographic toner.

The manufactured toner was put into a toner cartridge of a copying machine (Premarge 38 manufactured by TOSHIBA CORP.), and an image was transferred onto a paper sheet. The reflection density of the formed image was about 0.9. This paper sheet was dipped in diethoxyethane to erase the image and dried. The reflection density of the paper sheet after the image was erased was about 0.1. As described above, when the color former and the developer were mixed with other components without dissolving the color former and the developer in a solvent and evaporating the solvent to develop color, no satisfactory coloration could be obtained.

Example 4

1 mol of 3-diethylamino-6-methyl-7-xylidinofluoran as a color former, 1 mol of propyl gallate as a developer, and 1 mol of cholic acid as a decolorizer were mixed in acetone. The solution was dropped onto filter paper to form a black spot. The reflection density of this black spot was measured and found to be about 0.6. Meanwhile, only the color former and the developer were mixed in acetone without any decolorizer. The solution was dropped onto filter paper, and the reflection density of the formed black spot was measured and found to be about 1.5. These results demonstrate that, in the solution in which the three components were dissolved, the amount of the developer which formed a complex together with the decolorizer was presumably larger than the amount of the developer which formed a complex together with the color former.

Next, the above three components were mixed in solid state, the mixture was melted by heating, and differential scanning calorimetry was performed. As a consequence, no peak of the developer was found, and the peaks of the color former and the decolorizer were substantially halved. This indicates that the affinity of the developer to the color former was substantially equivalent to the affinity of the developer to the decolorizer.

Separately, 1 mol of 3-diethylamino-6-methyl-7-xylidinofluoran as a color former and 1 mol of propyl gallate as a developer were dissolved in ethyl alcohol to prepare a homogeneous solution. The solvent was evaporated, and the resultant material was dried to develop color. 8 parts by weight of this colored mixture, 20 parts by weight of cholic acid as a decolorizer, and 72 parts by weight of 1-docosanol as wax were mixed. The mixture was heated to 69° C. as the melting point of 1-docosanol and put into a mold to form crayon.

A dark black image was drawn on a paper sheet with this crayon. The reflection density of this image was 1.6. This paper sheet was dipped in diethoxyethane to erase the image and dried. The reflection density of the paper sheet after the image was erased was about 0.14.

As described above, when free energy $\alpha$ required for the decolorizer and the developer to form a complex is substantially equivalent to free energy $\beta$ required for the color former and the developer to form a complex, a good erased state can be obtained by increasing the amount of the decolorizer.

Example 5

1 g of dogtooth violet starch was dissolved in 50 cc of hot water, and an A4 copy sheet was coated with the solution with a brush and dried. After the procedure was repeated, the increase in weight of the paper sheet was measured to determine the amount of starch which permeated the paper sheet. By changing the number of times of coating, paper samples having average starch permeation amounts of 0.5, 1.2, 2.4, and 3.2 g were manufactured.

1 mol of PSD-184 (manufactured by Nippon Soda Co. Ltd.) as a color former and 1 mol of propyl gallate as a developer were dissolved in ethyl alcohol to prepare a homogeneous solution. The solvent was evaporated, and the resultant material was dried to develop color. 4 parts by weight of this colored mixture, 4 parts by weight of cholic acid as a decolorizer, 1 part by weight of 1-docosanol as wax, 90 parts by weight of a styrene-butyl acrylate copolymer (acrylate content 6 wt %) as a binder resin, and 1 part by weight of a charge control agent (LR-147 manufactured by Nippon Carret Inc.) were mixed, and the mixture was well kneaded using a kneader. The kneaded product was pulverized by a pulverizer to obtain a powder having an average particle size of 10 $\mu$m. 1 part by weight of hydrophobic silica was externally added to the resultant powder to manufacture black electrophotographic toner. The content of the decolorizer (cholic acid) in this toner was smaller than that in the toner manufactured in Example 3.

The manufactured toner was put into a toner cartridge of a copying machine (Premarge 38 manufactured by TOSHIBA CORP.), and an image was transferred onto the starch-penetrated paper sheets. The reflection density of the formed image was about 1.4 on any of these paper sheets. These paper sheets were dipped in diethoxyethane to erase the images and dried. The reflection densities of the paper sheets after the images were erased are as shown in Table 1 below. As Table 1 shows, when starch has penetrated a paper sheet, a good erased state can be obtained even when the decolorizer amount in toner is small.

TABLE 1

| Starch amount | Reflection density after erasure |
|---|---|
| 0.5 | 0.5 |
| 1.2 | 0.2 |
| 2.4 | 0.05 |
| 3.2 | 0.06 |

Example 6

1 mol of 2-anilino-6-(N-ethyl-N-isobutylamino)-3-methylfluoran as a color former and 1 mol of propyl gallate as a developer were dissolved in ethyl alcohol to prepare a homogeneous solution. The solvent was evaporated, and the resultant material was dried to develop color. The absorbance of this solution was 1.8 at a concentration of 5 mmol/L.

4 parts by weight of this colored mixture, 1 part by weight of 1-docosanol as wax, 93 parts by weight of a styrene-butyl acrylate copolymer (acrylate content 6 wt %) as a binder resin, and 1 part by weight of a charge control agent (LR-147 manufactured by Nippon Carret Inc.) were mixed, and the mixture was well kneaded using a kneader. The kneaded product was pulverized by a pulverizer to obtain a powder having an average particle size of 10 $\mu$m. 1 part by weight of hydrophobic silica was externally added to the resultant powder to manufacture black electro-photographic toner.

The manufactured toner was put into a toner cartridge of a copying machine (Premarge 38 manufactured by TOSHIBA CORP.), and an image was transferred onto a paper sheet. The reflection density of the formed image was about 1.5. This paper sheet was dipped in a saturated methylethylketone solution of methyl cholate as a decolorizer to erase the image, and the paper sheet was dried. The reflection density of the paper sheet after the image was erased was about 0.04.

As a control, 1 mol of ETAC (manufactured by Yamada Chemical Co. Ltd.) as a color former and 1 mol of propyl gallate as a developer were dissolved in ethyl alcohol to prepare a homogeneous solution. The solvent was evaporated, and the resultant material was dried to develop color. The absorbance of this solution was 0.5 at a concentration of 5 mmol/L.

4 parts by weight of this colored mixture, 1 part by weight of 1-docosanol as wax, 93 parts by weight of a styrene-butyl acrylate copolymer (acrylate content 6 wt %) as a binder resin, and 1 part by weight of a charge control agent (LR-147 manufactured by Nippon Carret Inc.) were mixed, and the mixture was well kneaded using a kneader. The kneaded product was pulverized by a pulverizer to obtain a powder having an average particle size of 10 $\mu$m. 1 part by weight of hydrophobic silica was externally added to the resultant powder to manufacture black electrophotographic toner.

The manufactured toner was put into a toner cartridge of a copying machine (Premarge 38 manufactured by TOSHIBA CORP.), and an image was transferred onto a paper sheet. The reflection density of the formed image was about 0.5. This paper sheet was dipped in diethoxyethane to erase the image and dried. The reflection density of the paper sheet after the image was erased was about 0.14. That is, no satisfactory coloration could be obtained when the absorbance of the solution of the color former and the developer was low.

Example 7

PSD-184 as a color former and propyl gallate as a developer used in Example 3 can be uniformly dissolved at a concentration of 0.1 mmol/L in both of ethyl alcohol used for mixing and diethoxyethane as an erase solvent. Hence, the reflection density of the image formed by the toner manufactured in Example 3 was about 1.5, and the reflection density of the paper sheet after the image was erased was about 0.1.

In contrast, bisphenol A is not completely dissolved at a concentration of 0.1 mmol/L in either ethyl alcohol or diethoxyethane. Accordingly, the reflection density of an image formed by toner manufactured in the same manner as in Example 3 by using PSD-184 as a color former and bisphenol A as a developer was about 1.2, and the reflection density of a paper sheet after the image was erased was about 0.4. That is, no good erase performance could be obtained.

Example 8

Equal mols of PSD-184 (manufactured by Nippon Soda Co. Ltd.) as a color former and propyl gallate as a developer were dissolved in acetone to prepare a homogeneous solution. The solvent was evaporated, and the resultant material was dried to develop color. 8 parts by weight of this colored mixture, 20 parts by weight of cholic acid as a decolorizer, and 72 parts by weight of 1-docosanol as wax were mixed. The mixture was heated to 69° C. as the melting point of 1-docosanol and put into a mold to form crayon.

A 10 cm×5 cm test paper sheet was placed on a hot plate heated to 100° C. The crayon formed as above was melted by pushing it against a position 1.5 cm from the lower edge of this test paper sheet. The test paper sheet was removed from the hot plate to fix the crayon and form a spot 2 mm in diameter. Diethoxyethane was charged in a lidded vessel to a depth of 1 cm, and the lower portion of the test paper sheet was dipped in this diethoxyethane to run chromatography. When the solvent rose to a height of 4.5 cm from the lower edge of the test paper sheet, the test paper sheet was removed and dried. Consequently, the colored spot moved to a position 80% of the moving distance (4.5 cm) of the solvent (the Rf value was 0.8). This colored spot was clearly visible, indicating that the color former and the developer moved together with the solvent while reacting with each other. On the other hand, the decolorizer did not move (the Rf value was 0) because it was not detected by irradiation by a UV lamp. 1-docosanol as wax did not move either. Therefore, the difference between the Rf values of the developer and the decolorizer was 0.8. When the image was erased by the solvent in this state, the image blurred to result in incomplete erasure.

Next, 1 mol of Blue63 (manufactured by Yamamoto Kasei K. K.) as a color former and 1 mol of propyl gallate as a developer were dissolved in ethyl alcohol to prepare a homogeneous solution. The solvent was evaporated, and the resultant material was dried to develop color. 4 parts by weight of this colored mixture, 10 parts by weight of potato starch as a decolorizer, 1 part by weight of 1-docosanol as wax, 84 parts by weight of a styrene-butyl acrylate copolymer (acrylate content 6 wt %), and 1 part by weight of a charge control agent (LR-147 manufactured by Nippon Carret Inc.) were mixed, and the mixture was well kneaded using a kneader. The kneaded product was pulverized by a pulverizer to obtain a powder having an average particle size of 10 $\mu$m. 1 part by weight of hydrophobic silica was externally added to the resultant powder to manufacture blue electro-photographic toner.

The manufactured toner was put into a toner cartridge of a copying machine (Premarge 38 manufactured by TOSHIBA CORP.), and an image was transferred onto a paper sheet. The reflection density of the formed image was about 1.5. This toner was used to print a straight line in a position 1.5 cm from the lower edge of a 10 cm×5 cm test paper sheet. In the same manner as described above, diethoxyethane was charged in a lidded vessel to a depth of 1 cm, and the lower portion of the test paper sheet was dipped in this diethoxyethane to run chromatography. Consequently, no components flowed out from the straight-line image, i.e., the straight-line images was completely erased. Therefore, the Rf values of both the developer and the decolorizer are 0, and the difference ΔRf was also 0. In this image forming material, the binder resin probably suppressed the diffusion of the color former, developer, and decolorizer.

Separately, Blue63 was used as a color former to manufacture crayon and chromatography was run following the same procedures as above. As a consequence, a spread of a colored spot of the color former and the developer was observed. No other components (the decolorizer and the wax) were detected by observation by UV irradiation. This indicates that the color former and the developer moved while interacting with each other. ΔRf was 0.2 on the average. Although erasure was incomplete because ΔRf exceeded 0.1, this demonstrates that erasure is possible to some extent.

This composition system can be used as inkjet ink containing no binder. For example, ΔRf is 0.1 or less in aqueous ink in which Blue63 and gallic acid in colored state are suspended in the form of ultra fine particles by a surfactant and which contains starch as a decolorizer. This ink can be well erased by either contact with an erase solvent or heating.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An erasable image forming material comprising a color former, a developer, and a decolorizer, wherein free energy α required for said decolorizer and said developer to form a complex and free energy β required for said color former and said developer to form a complex have a relationship represented by $$\alpha \leqq \beta \leqq 10 \text{ Kcal/mol.}$$

2. An erasable image forming material comprising a color former, a developer, and a decolorizer and erasable by contact with an erase solvent, wherein free energy α required for said decolorizer and said developer to form a complex and free energy β required for said color former and said developer to form a complex have a relationship represented by $$\alpha \leqq \beta \leqq 10 \text{ Kcal/mol.}$$

3. The material according to claim 2, wherein the free energy α required for said decolorizer and said developer to form a complex and the free energy β required for said color former and said developer to form a complex have a relationship represented by $$\alpha \leqq \beta \leqq 5 \text{ Kcal/mol.}$$

4. The material according to claim 2, further comprising a material having a function of suppressing outflow of said color former, said developer, and said decolorizer from an image region formed by said image forming material when said erase solvent enters the image region.

5. The material according to claim 2, wherein said material having the function of suppressing outflow of said color former, said developer, and said decolorizer from the image region is selected from the group consisting of a binder resin and a microcapsule shell material.

6. The material according to claim 2, wherein said decolorizer is a low-molecular decolorizer selected from the group consisting of a sterol compound, cyclic sugar alcohol and a derivative thereof, and a non-aromatic cyclic compound, other than cyclic sugar alcohols, of a not less than 5-membered ring having a hydroxyl group.

7. The material according to claim 2, wherein said decolorizer is a polymer decolorizer selected from the group consisting of starch, cellulose, a cellulose derivative, polyacrylic acid, polymethacrylic acid, polyviphenylacrylate, polyacrylamide, polymethacrylamide, polyvinylester, polyphenylene, polyethersulfone, polyetherketone, polysulfone, polyvinylpyrrolidone, polyamide, polybenzimidazole, polyphenyleneether, polyphenylenesulfide, polycarbonate, polydivinylbenzene, and melamine resin.

8. An erasable image forming material comprising a color former, a developer, and a decolorizer and erasable by contact with an erase solvent, wherein said decolorizer and said developer have the following relationship:

$$0 \leqq \Delta Rf \leqq 0.1$$

where ΔRf is a difference between Rf values, represented by (component moving distance/solvent moving distance), of said decolorizer and said developer when said decolorizer and said developer are separated by chromatography using said erase solvent.

9. The material according to claim 8, wherein free energy α required for said decolorizer and said developer to form a complex and free energy β required for said color former and said developer to form a complex have a relationship represented by $$\alpha \leqq \beta \leqq 10 \text{ Kcal/mol.}$$

10. The material according to claim 8, wherein said decolorizer is a low-molecular decolorizer selected from the group consisting of a sterol compound, cyclic sugar alcohol and a derivative thereof, and a non-aromatic cyclic compound, other than cyclic sugar alcohols, of a not less than 5-membered ring having a hydroxyl group.

11. The material according to claim 8, wherein said decolorizer is a polymer decolorizer selected from the group consisting of starch, cellulose, a cellulose derivative, polyacrylic acid, polymethacrylic acid, polyviphenylacrylate, polyacrylamide, polymethacrylamide, polyvinylester, polyphenylene, polyethersulfone, polyetherketone, polysulfone, polyvinylpyrrolidone, polyamide, polybenzimidazole, polyphenyleneether, polyphenylenesulfide, polycarbonate, polydivinylbenzene, and melamine resin.

12. An erasable image forming material comprising a color former L, a developer D, and a decolorizer, wherein said color former L and said developer D satisfy concentration [D]≧concentration [L] in a solvent and are mixed under a condition by which optical density of a solution is proportional to a concentration product [D]·[L], and said mixture is further mixed with said decolorizer.

13. The material according to claim 12, wherein absorbance of a solution with a concentration of 5 mmol/L, prepared by dissolving said color former L and said developer D in a solvent with a dielectric constant of 4 to 80, is not less than 1.0.

14. The material according to claim 13, wherein said solvent having a dielectric constant of 4 to 80 is selected form the group consisting of methylene chloride, ethyl alcohol, and acetone.

* * * * *